US006764433B1

(12) United States Patent
Sims

(10) Patent No.: US 6,764,433 B1
(45) Date of Patent: Jul. 20, 2004

(54) MINI BODY PRESS

(76) Inventor: Lynwood Sims, 2704 Oakhurst Dr., Rock Hills, SC (US) 29732

( * ) Notice: Subject to any disclaimer, the term of this patent is extended or adjusted under 35 U.S.C. 154(b) by 0 days.

(21) Appl. No.: 10/126,553

(22) Filed: Apr. 19, 2002

Related U.S. Application Data

(60) Provisional application No. 60/285,045, filed on Apr. 19, 2001.

(51) Int. Cl.[7] ..... A63B 21/00

(52) U.S. Cl. ..... 482/139

(58) Field of Search ..... 482/121, 105, 482/124, 106, 139, 112, 133, 122, 127, 128, 140; D21/662

(56) References Cited

U.S. PATENT DOCUMENTS 5,462,518 A * 10/1995 Hatley et al. ..... 482/124
5,637,067 A * 6/1997 Ausmus ..... 482/140
6,368,257 B1 * 4/2002 Kaplan et al. ..... 482/124

* cited by examiner

*Primary Examiner*—Glenn E. Richman
(74) *Attorney, Agent, or Firm*—Dougherty, Clements, Hofer & Bernard

(57) ABSTRACT

A mini body press that is configurable to allow a user to perform a multitude of upper body workout exercises. The mini body press includes a molded contoured back brace member, a pair of shoulder harnesses, a pair of hand grips, and a number of elastic straps that are securable between the hand grips and the back brace member.

1 Claim, 1 Drawing Sheet

MINI BODY PRESS

This application claims the benefit of Provisional application Ser. No. 60/285,045, filed Apr. 19, 2001.

TECHNICAL FIELD

The present invention relates to portable exercise devices and more particularly to a mini body press that includes a molded, contoured back brace member, a pair of removable J-shaped shoulder harnesses extending from an edge of the contoured back brace member, a number of knobs extending outwardly from various locations on the contoured back brace member, and a pair of hand-grips grips each securable to one or more of the knobs with one or more elastic straps having a knob connecting looped formed at one end thereof and a handle connecting loop formed at the other end; the handle being attachable to one or more straps by securing a handle rod that extends into the handle through the handle connecting loop of the elastic strap to be attached.

BACKGROUND OF INVENTION

It is often desirable, for individuals who are away from their home to exercise properly. It would be desirable, therefore, for these individuals to have a mini body press which would allow them to perform a multitude of upper body work out exercises so that they could maintain and/or build muscle tone in the chest, shoulders and arms while away from home.

SUMMARY OF INVENTION

It is thus an object of the invention to provide a mini body press that includes a molded, contoured back brace member, a pair of removable J-shaped shoulder harnesses extending from an edge of the contoured back brace member, a number of knobs extending outwardly from various locations on the contoured back brace member, and a pair of hand-grips each securable to one or more of the knobs with one or more elastic straps having a knob connecting looped formed at one end thereof and a handle connecting loop formed at the other end; the handle being attachable to one or more straps by securing a handle rod that extends into the handle through the handle connecting loop of the elastic strap to be attached.

Accordingly, a mini body press is provided. The mini body press includes a molded, contoured back brace member, a pair of removable J-shaped shoulder harnesses extending from an edge of the contoured back brace member, a number of knobs extending outwardly from various locations on the contoured back brace member, and a pair of hand-grips each securable to one or more of the knobs with one or more elastic straps having a knob connecting looped formed at one end thereof and a handle connecting loop formed at the other end; the handle being attachable to one or more straps by securing a handle rod that extends into the handle through the handle connecting loop of the elastic strap to be attached.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figures 1, 2:
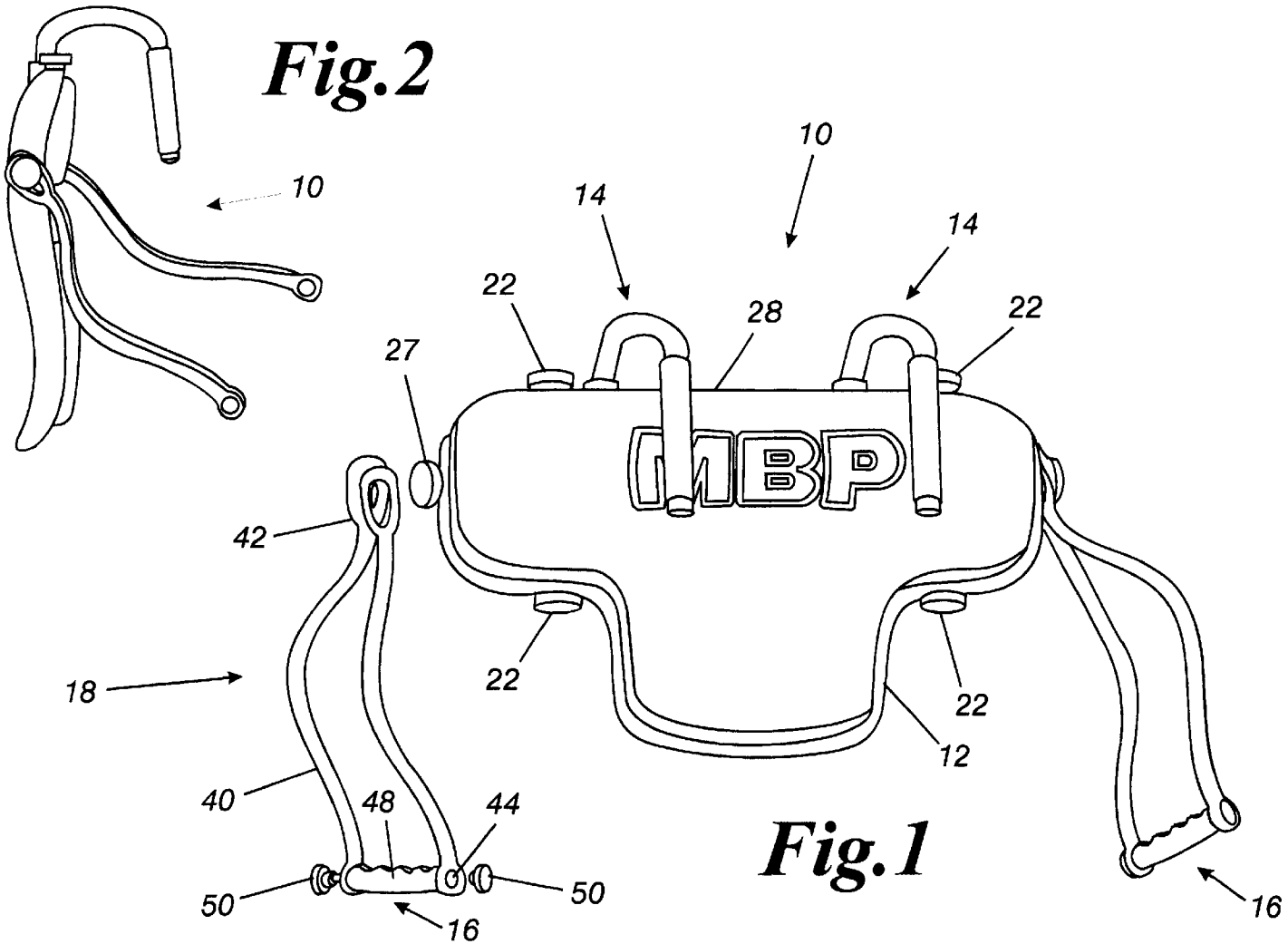
FIG. 1 is a perspective view of an exemplary embodiment of the mini body press of the present invention.
FIG. 2 is a side plan view of an exemplary embodiment of the present invention.

FIGS. 1 and 2 show various aspects of an exemplary embodiment of the mini body press of the present invention generally designated 10. Mini body press 10 includes a molded contoured back brace member generally designated 12, a pair of removable J-shaped shoulder harnesses each generally designated 14, two hand grip assemblies each generally designated 16, a number of elastic straps each generally designated 18.

Molded contoured back brace member 10 is molded to contour to the back and spine of the user and includes a number of knobs 22 to which the elastic straps are secured when performing exercises as described below. The J-shaped shoulder harnesses 14 are connectable to a top edge 28 of back brace member 12 and are used while performing some exercises if desired. Each of the elastic straps 18 includes a center portion 40, knob connecting loop 42 and a handle connecting loop 44. The handle connecting loops are attached to a handle 48 by screwing a handle rod member 50 into a side end of a handle member 48 and through handle connecting loop 44 of the elastic band to be attached. By connecting the elastic straps to various knobs 22 the user can perform a variety of exercises. In addition, by controlling the number of elastic straps 18 that are used, the user may vary the intensity of the workout.

It can be seen from the preceding description that a mini body press has been provided.

It is noted that the embodiment of the mini body press described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A mini body press comprising:

a molded, contoured back brace member;

a pair of removable J-shaped shoulder harnesses extending from an edge of the contoured back brace member;

a number of knobs extending outwardly from various locations on the contoured back brace member; and a pair of hand-grips each securable to one or more of the knobs with one or more elastic straps having a knob connecting looped formed at one end thereof and a handle connecting loop formed at the other end;

the handle being attachable to one or more straps by securing a handle rod that extends into the handle through the handle connecting loop of the elastic strap to be attached.

* * * * *